US006192534B1

(12) United States Patent
Restivo

(10) Patent No.: US 6,192,534 B1
(45) Date of Patent: Feb. 27, 2001

(54) LIFTING HARNESS FOR TRANSPORTING NON-AMBULATORY PATIENTS

(76) Inventor: Sam T. Restivo, 14830 Charlmont, Houston, TX (US) 77083

( * ) Notice: Subject to any disclaimer, the term of this patent is extended or adjusted under 35 U.S.C. 154(b) by 0 days.

(21) Appl. No.: 09/303,408

(22) Filed: May 3, 1999

(51) Int. Cl.[7] ..... A61G 7/10
(52) U.S. Cl. ..... 5/89.1; 294/67.31; 294/118
(58) Field of Search ..... 294/66.1, 67.1, 294/67.2, 67.3, 67.31, 106, 118, 140, 902; 5/81.1 R, 83.1, 86.1, 89.1; 119/725, 728; 414/921

(56) References Cited

U.S. PATENT DOCUMENTS 616,282 * 12/1898 Allen ..... 5/89.1
1,033,277 * 7/1912 Seashole ..... 294/67.31 X
2,743,701 * 5/1956 Boyd ..... 294/118 X
3,469,269 * 9/1969 Brown ..... 5/86.1
3,608,104 * 9/1971 Van Gerren ..... 5/83.1
4,509,785 * 4/1985 Van Raemdonck et al. ..... 294/118
4,882,798 * 11/1989 Worsnop ..... 294/140 X
5,325,550 * 7/1994 Dearstyne et al. ..... 294/67.31 X

* cited by examiner

*Primary Examiner*—Johnny D. Cherry
(74) *Attorney, Agent, or Firm*—Robert W B Dickerson

(57) ABSTRACT

A movable device for transporting a non-ambulatory patient, the device having a frame member which has opposed tubular arms, each pivotally linked to torso grasping chest supports, the device may be supported by and carried by a lift device.

6 Claims, 3 Drawing Sheets

LIFTING HARNESS FOR TRANSPORTING NON-AMBULATORY PATIENTS

BACKGROUND OF THE INVENTION

The field of application of this invention lies in the medical treatment and/or recuperative arena. It is particularly intended to be used by non-ambulatory patients, i.e., by those requiring assistance to move about. Numerous devices have heretofore been developed to permit the securing of a patient to a harness, sling, or the like, and thereafter transporting the patient from one position or location to another. Examples of such presently used or described apparatus are: (1) CM Assist 550 Mobile Lift by Columbus McKennon Corp.; (2) GINCO SURE HANDS lift system, by Sure Hands International; and (3) U.S. Pat. No. 4,509,785 issued Apr. 9, 1985. All of the described devices include, during use, rigid arms for grasping the torso of a patient (see C M Hugger of item No. 1, above, and supporting members 3 of the above mentioned patent). Since many such patients have suffered from muscular atrophy, their torsos tend to sink downwardly during upward movement of the lift device, thus urging the device's rigid arms into and against the patients arm pits. This can be extremely uncomfortable. Applicant's invention was designed to substantially overcome this problem.

SUMMARY OF THE INVENTION

Applicant's harness receives a patient's torso by grasping him with opposed chest supports. The harness is secured to and raised by an associated lift device. His legs are received by leg supports. As the body is raised, the opposed sides of the harness frame, including the chest supports, close on each other. Such supports remain proximate to the chest, rather than ride upwardly, due to the ability of the harness sides to pivot, relative to the chest supports.

DESCRIPTION OF A PREFERRED EMBODIMENT

Figure 1:
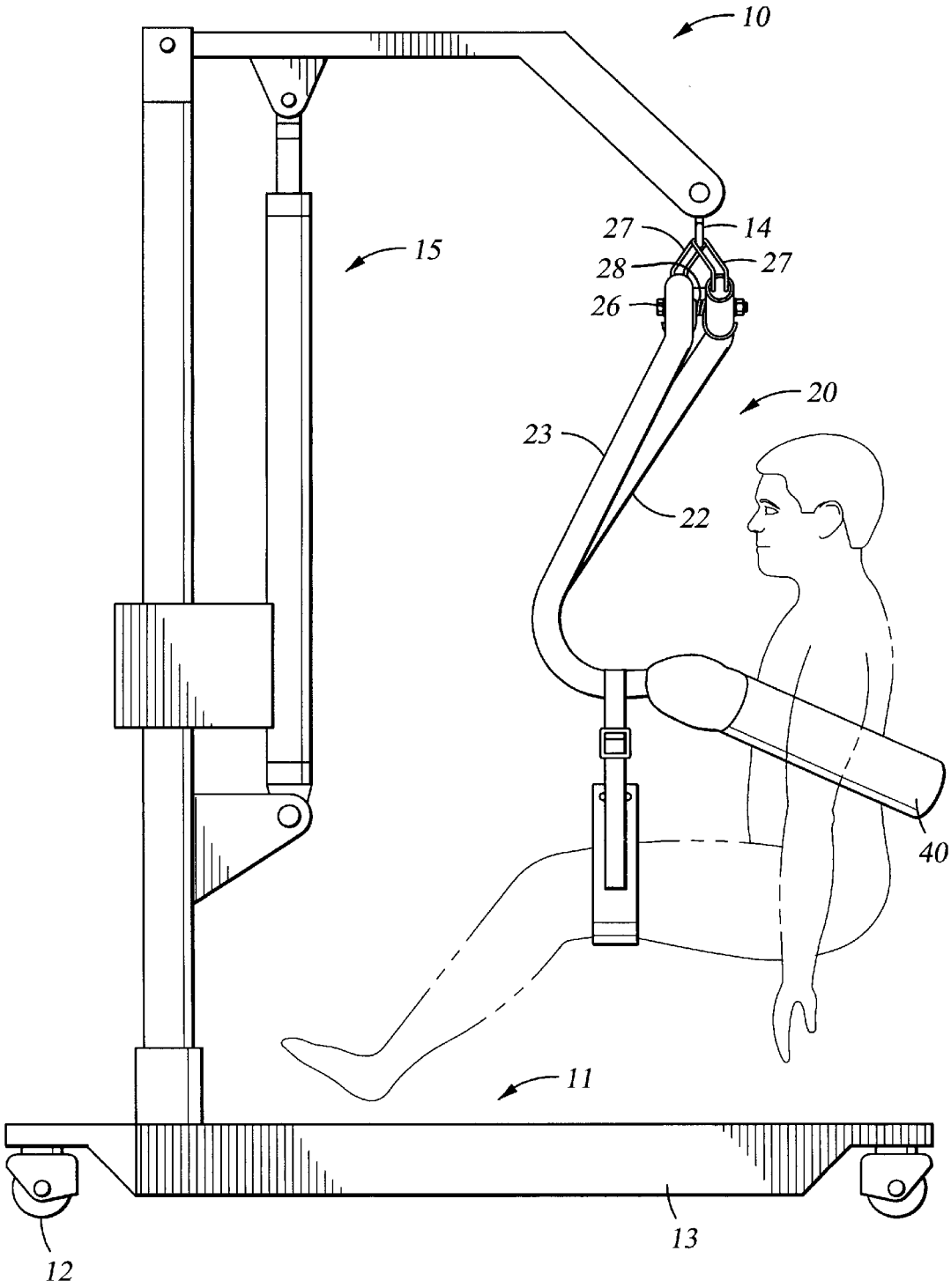
FIG. 1 is a side elevation of the harness attached to the mobile, or traveling, lift.
Figure 2:
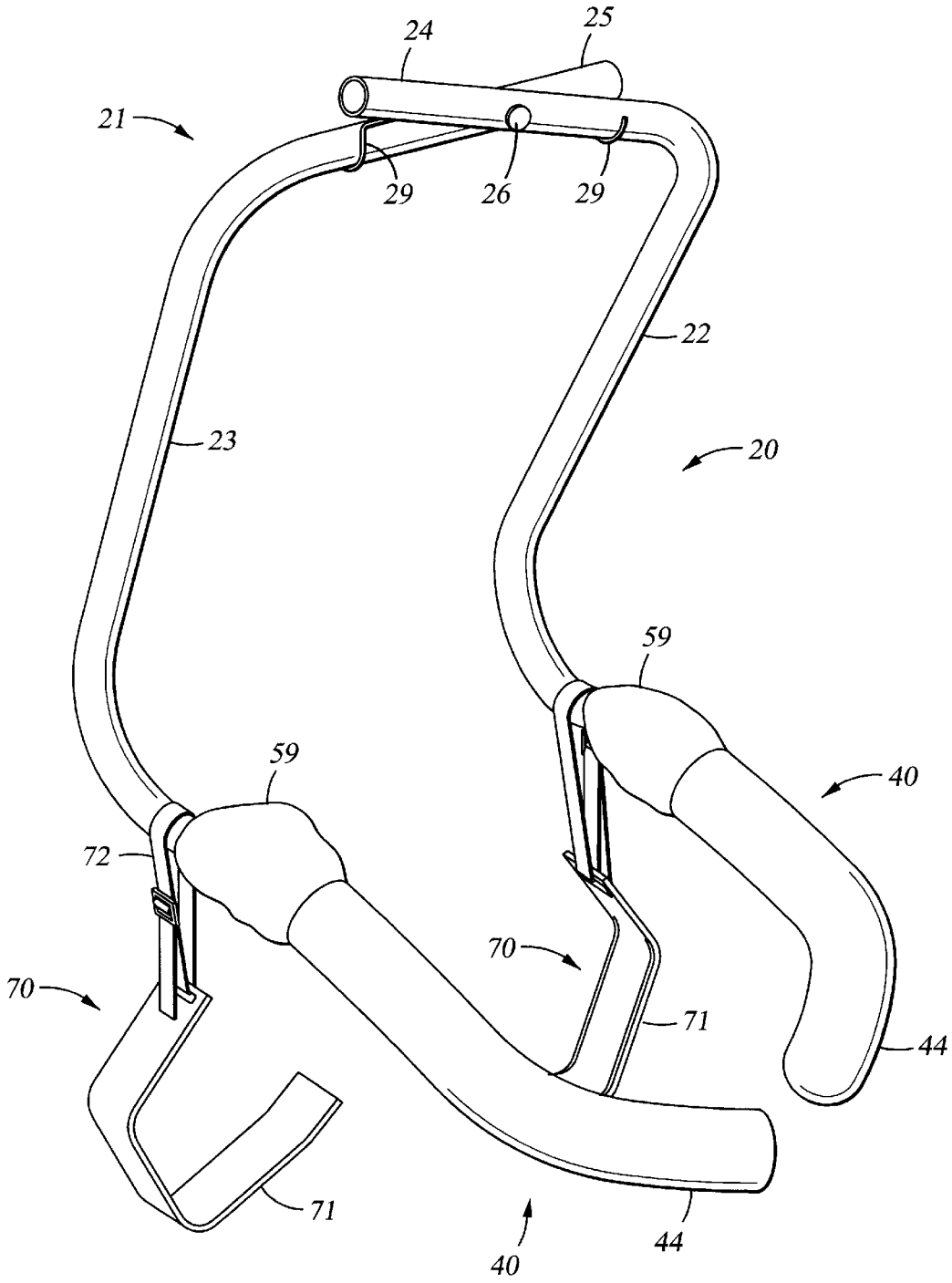
FIG. 2 is a perspective of the harness device.

FIG. 1 illustrates a movable, traveling lift 10. This lift normally includes a carriage 11 having wheels or casters 12 to impart mobility. The carriage may include a pair of parallel tracks 13, only one being shown. The lift, as such, does not comprise a part of this invention. A hydraulic mechanism 15 would normally be provided to permit elevation of harness device 20 and a patient, generally shown in phantom lines, using the device. Hook connector 14 permits the lift to engage the harness.

Look now at FIGS. 2–5, depicting the hinged harness comprising this invention. The harness includes a frame 21 which includes a pair of bent tubular arms 22 and 23, respectively. Near one end of each arm, as at 24, 25, said arms are pivotally linked, scissors style, by pivot pin 26. Hooks 27 link connector 14 of lift 10, to the open ends 24, 25 of each of the tubular arms 22, 23. Spring member 28 encircles pivot pin 26 intermediate arms 22 and 23, and has its curved ends 29 engage said arms. The spring action of member 28 biases the frame toward the starting position of FIG. 2. The patient's weight opposes such bias.

The other end 31 of each of harness frame arms 22 and 23 (see FIG. 3) is linked to the facing end 41 of a tubular member 42 of a padded chest support 40. This linkage occurs by virtue of a buckle mechanism 50.

Each of the pair of chest supports 40 includes a tubular member 42 and is encompassed by padding 43. The end 44 of each chest support 40, away from the pivot-permitting buckle mechanism 50, is inwardly bent, each toward the other, so as to jointly form a chest or thorax gripping device.

The buckle mechanism 50 is substantially enclosed by a protective cylindrical layer of spongy material 59, which may be removed for access therein. The buckle itself includes male fastener 51 whose sub 52 is fitted within the hollow interior of end 41 of tubular member 42, and whose tongue 54 is received by female fastener or clevis 55. Stub 56 of said clevis is fitted within the hollow interior of end 31 of one of tubular arms 22, 23 of frame 21. Finally, pivot pin 60 secures fasteners 51 and 55 against axial separation, but permits relative rotation. Note the presence of opposed annular shoulders 61, 62 of male fastener 51, as well as annular shoulder 63 on clevis 55. Shoulder 61 abuts tube end 41; shoulder 62 against the open jaws 65 of said clevis and clevis shoulder 63 against tube end 31. Also note the angular bevel 64 on each clevis jaw 65. This bevel, or cut-out, serves as a stop or limit to clockwise rotational movement, as oriented in FIGS. 4 and 5.

Adjustable leg supports 70 may each include open-ended stirrup 71 which stirrup is linked to adjustable strap 72. Each said strap slidingly and downwardly depends from one of said frame arms 22 or 23, just forward of protective material 59.

Figure 3:
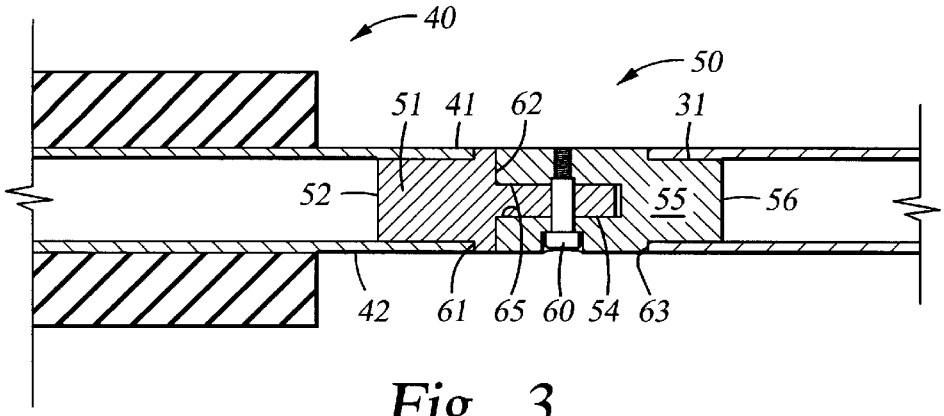
FIG. 3 is an axial section through the pivot connection.
Figure 4:
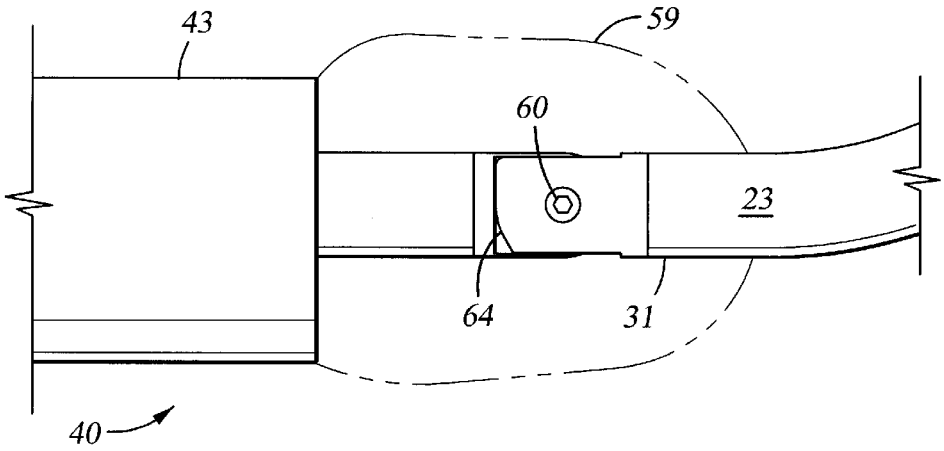
FIGS. 4 and 5, respectively, are elevations depicting the pivot components in an unpivoted, or straight line relationship (FIG. 4), and in a pivoted, angular relationship, of approximately 30 degrees (FIG. 5).
Figure 5:
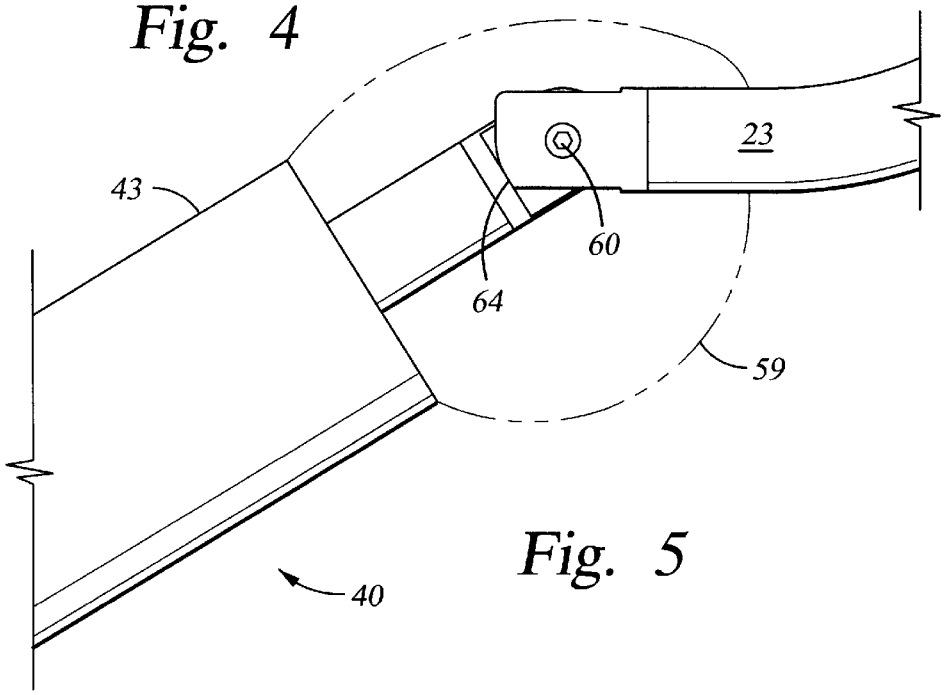

Consider now the utilization of the device. The invention would normally be positioned so that the patient would be facing forwardly, as shown in FIG. 1. The leg support stirrups would be positioned so as to receive the patients legs, or preferably, thighs. The chest supports 40 would loosely receive the patient's chest. The hydraulic lift mechanism 15 would be caused to gradually lift the harness device of this invention, including the leg supports 70. As the patient's body weight is encountered, a downward force is exerted on the harness, particularly on the stirrups 71. Herein began troubles with prior art devices, particularly when the patient's muscles were flaccid, and the frame arms were rigid with the chest supports. As the legs were lifted, the user's rump and torso would slip downwardly, causing the chest support members to slide upwardly against the user's arm pits. This could be painful. However, with Applicant's lifting harness, as the legs begin to be lifted, conjointly tubular arms 22 and 23 begin to scissor about pivot pin 26 moving the arms and chest supports closer together. Along with the tendency of the user's rump and torso to move downwardly, relative to the harness, and particularly the stirrups 71, the chest supports 40 are able to pivot downwardly as illustrated in FIG. 5, until the chest supports are scissored together sufficiently to secure the patient to the harness. Thus, the pivot action relative to the harness frame and chest support, as permitted by the buckle arrangement of FIGS. 3–5, is able to overcome the problems previously encountered by the prior art, relative to patient discomfort, during use, as suffered by patients with less than complete muscle tone.

Although only a single embodiment has been described, it should be obvious that numerous embodiments would be possible by one skilled in the art without departing from the spirit of the invention, particularly in the realm of the pivoting structure between the chest support and the harness frame. Various types of pivot permitting arrangements, such as pin-in-slots, spaced apertures, and other means for permitting rotating movement between parts, could fulfill the goal accomplished hereby, relying on the teachings contained herein, the scope being determined by the following claims.

What is claimed is:

1. A device for use in conjunction with a powered mechanism, to assist in the lifting and transporting of a patient, said device including:

a harness member which includes a frame having opposed tubular arm means, pivotally connected near one end of each said arm means, means for supporting the chest of said patient, means for pivotally connecting each of said tubular arm means to said means for supporting said chest wherein said chest supporting means includes a pair of opposed tubular, padded members, inwardly bent at one end.

2. The device of claim 1 and including means linking said harness member to said powered mechanism.

3. A harness member to assist a powered mechanism in the lifting of a patient having impaired muscles, said device including:

a harness member having a frame which includes a pair of tubular members pivotally pinned together adjacent one end for a scissors action, said harness member also including chest support means pivotally joined to each said tubular member, said chest support means comprising a pair of bent, padded members; and leg support means depending from said frame.

4. The device of claim 3 wherein said leg-support means includes a pair of stirrups, one depending by a strap from each of said frame's tubular members.

5. The device of claim 3 wherein said chest support means includes a female and a male fastener linked by pin means.

6. The device of claim 5 and including means for linking said harness member to said powered mechanism whereby a downward force on said harness member results in said chest support padded members closing on each other.

* * * * *